US005321413A

United States Patent [19]

Lenormand

[11] Patent Number: 5,321,413

[45] Date of Patent: Jun. 14, 1994

[54] OFFSET ACTIVE ANTENNA HAVING TWO REFLECTORS

[75] Inventor: Régis Lenormand, Blagnac, France

[73] Assignee: Alcatel Espace, Courbevoie, France

[21] Appl. No.: 996,156

[22] Filed: Dec. 23, 1992

[30] Foreign Application Priority Data

Dec. 23, 1991 [FR] France ..... 91 16028

[51] Int. Cl.[5] ..... H01Q 19/06

[52] U.S. Cl. ..... 343/755; 343/753; 343/781 P

[58] Field of Search ..... 343/753, 754, 755, 781 P, 343/781 CA, 786, 853

[56] References Cited

U.S. PATENT DOCUMENTS

| | | | |
|---|---|---|---|
| 2,975,419 | 3/1961 | Brown | 343/755 |
| 4,246,585 | 1/1981 | Mailloux | 343/854 |
| 4,259,674 | 3/1981 | Dragon et al. | 343/753 |
| 4,435,714 | 3/1984 | Luh | 343/753 |
| 4,595,926 | 6/1986 | Kobus et al. | 343/754 |
| 4,743,914 | 5/1988 | Schuss et al. | 343/754 |
| 4,755,826 | 7/1988 | Rao | 343/781 P |
| 4,975,712 | 12/1990 | Chen | 343/754 |

FOREIGN PATENT DOCUMENTS

| | | |
|---|---|---|
| 0028018 | 5/1981 | European Pat. Off. . |
| 0446610 | 9/1991 | European Pat. Off. . |

*Primary Examiner*—Donald Hajec
*Assistant Examiner*—Tan Ho
*Attorney, Agent, or Firm*—Sughrue, Mion, Zinn, Macpeak & Seas

[57] ABSTRACT

An offset type active antenna having two reflectors in a periscopic configuration. A radio lens is provided at the focii of the two reflectors. It comprises a collector and a primary array that is considerably larger in size than the collector. The "small" sources of the collector are in a geographically identical one-to-one correspondence with the "big" sources of the primary array, and they are respectively connected together via devices for providing fine phase adjustment.

5 Claims, 2 Drawing Sheets

OFFSET ACTIVE ANTENNA HAVING TWO REFLECTORS

The present invention relates to an offset active antenna having two reflectors, said two reflectors facing each other via their focii in a "periscope" kind of configuration, well known under the term "offset fed Gregorian geometry".

It relates in particular to an offset antenna of the type described in the article by Robert J. Mailloux entitled "Phased array theory and technology" published in the American journal "Proceedings of the IEEE", Volume 70, No. 3, March 1982, see FIG. 44(*b*), page 281, the commentary thereon, and the references on page 280.

BACKGROUND OF THE INVENTION

By way of example, highly diagrammatic accompanying FIG. 1 recalls the known configuration of a two-reflector active antenna of the offset type, i.e. an antenna of the kind to which the present invention applies.

That antenna uses the optical periscope principle and comprises an active array 1 of small size relative to the direct radiation active array that would be required for radiating a beam of diameter D identical to that which is finally radiated by the offset configuration two-reflector antenna.

The active array 1 is associated in a manner that is conventional for this kind of array with phase adjusting devices 2, and also with amplifiers and filters (not shown), which devices are referred below as "controls" in order to comply with the terminology used in the art.

The beam of diameter d radiated by the active array 1 is initially reflected by a first parabolic reflector 3 which concentrates the beam at its focus F, after which the beam continues to propagate from said focus F to illuminate a second parabolic reflector 4 facing the reflector 3 via the focus F with which it is confocal, thereby finally radiating a beam of parallel rays having a width D.

It should be observed that in such a configuration, the emitting source 1 is offset relative to the beam of width D that is finally radiated, and thus that the antenna is indeed an "offset" antenna.

This periscope type configuration having two reflectors 3 and 4 is used to reduce the dimensions of the active source 1, and, a priori, it is more advantageous than the simple configuration which could be provided by having an active source of size D equal to the size of the beam which would than be emitted directly.

It turns out, in practice, that the constraints applicable to the elements of the small-sized active source 1 are different from those that would apply to an equivalent large-sized active source used for directly radiating the beam of size D. Thus, in reality, in order to obtain the same performance, it is necessary to reduce the size of the elements of the source 1, and as a result to increase the number of adjustment or "control" devices associated with said source.

As a result the economic balance and the size characteristics of a conventional antenna as shown in FIG. 1 turn out, in contrast to what might have been expected a priori, not to produce any significant advantage over a simple active array antenna used for direct radiation.

SUMMARY OF THE INVENTION

The invention seeks to remedy this drawback. To this end, it provides an offset type active antenna having two reflectors, the antenna including, at the focii of these two reflectors, a radio wave lens having a "collector" first face whereby it receives and picks up the reflected concentrated beam derived from that emitted by the active source of said antenna by the first reflector encountered by the beam, said collector being placed at the focus of said first reflector, and having an opposite, "primary beam" face that re-emits towards the second reflector the energy which is transmitted via interconnection from said collector, said primary array being placed at the focus of said second reflector. The collector sources are respectively connected one by one to corresponding sources of the primary array having the same geometrical distributions, but each of said collector sources is much smaller in size than the primary array source associated therewith. The connection between each "small" collector source and the corresponding "big" source of the primary array includes a device for fine phase adjustment. This phase adjustment device is sampled over several distinct portions of said primary array source, which is thus, in fact, constituted by an assembly of as many elementary sources as there are portions.

BRIEF DESCRIPTION OF THE DRAWINGS

Embodiments of the invention are described by way of example with reference to the accompanying drawings, in which.

DETAILED DESCRIPTION

Figure 1:
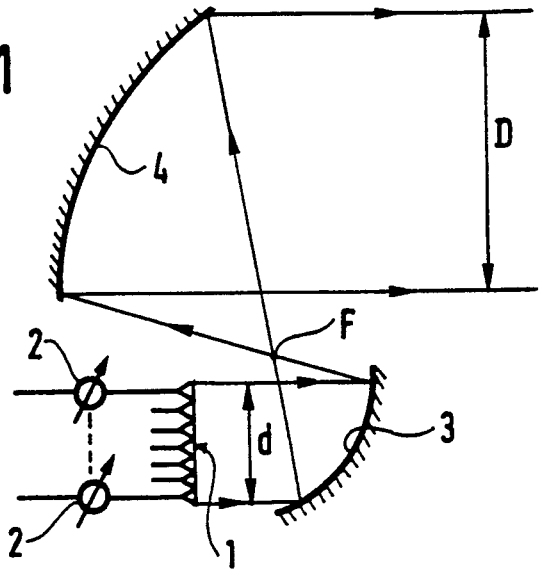
FIG.1 PRIOR ART
FIG. 1 is a diagram of the prior art as described above.
Figure 2:
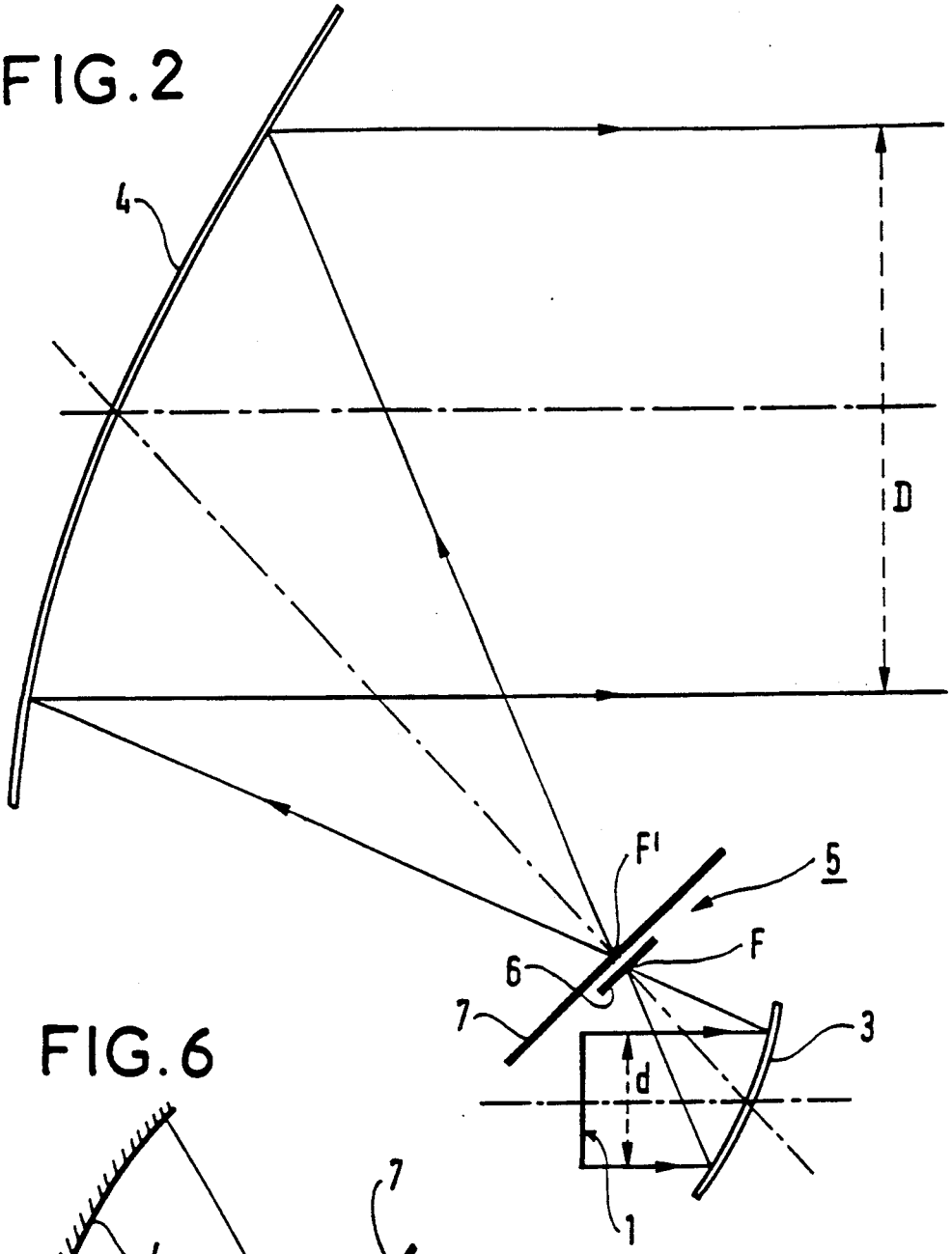
FIG. 2 is a highly simplified diagram of the two-reflector offset active antenna of the invention, said diagram being comparable to the above-described diagram of FIG. 1 which relates to the prior art.

In FIG. 2, items that are identical to those of FIG. 1 are designated by the same reference numerals to facilitate understanding and to avoid further description.

Figure 3:
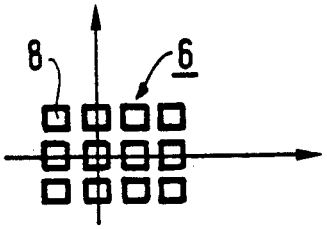
FIGS. 3 and 4 are respective theoretical diagram for facilitating understanding of the invention and showing the zones that are illustrated by the collector and by the corresponding re-emitting zone on the primary array.
Figure 4:
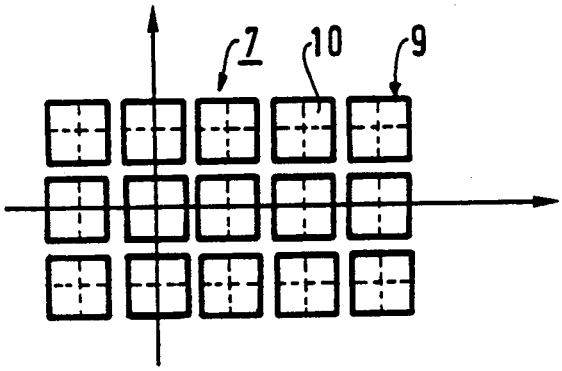

This antenna differs from that of FIG. 1 in that it includes a microwave lens 5 at the focii F and F' of the two parabolic reflectors 3 and 4, the lens comprising two interconnected arrays of sources:

a "collector", first array of sources 6 placed at the focus F of the reflector 3 and receiving the beam that has been reflected and concentrated by the reflector 3. This collector 6 is relatively small in size, and it is made up of a mosaic comprising an integer number n of "small" elementary sources 8 (see FIG. 3), with each of these receiving sources 8 being constituted by a small horn, for example; and a "primary", second array 7 of sources 9 of considerably greater size, and in any case having surface area dimensions several times larger than the surface area dimensions a, FIG. 3, of the source 8 of the array 6, which primary array is placed at the focus F' of the second reflector 4. This primary array 7 occupies a surface parallel to that of the collector 6, defining a much larger surface area of sources 9 than that of the sources 8 of array 6 and it too is constituted by a mosaic (see FIG. 4) that is geometrically similar to that of the collector 6, i.e. it comprises the same integer number n of "big" unit sources 9, with each of these unit re-emitting sources being itself made up of a small mosaic comprising an integer number p (equal to 4 in the drawing) of small horns 10.

The small receiving sources 8 of the collector 6 are in one-to-one correspondence with the big re-emitting sources 9 of the primary array 7, i.e. the respective distributions of said sources 8 and 9 are the same in each of the arrays 6 and 7. A source 8 of the collector is connected to the geographically corresponding source 9 of the primary array via connection means that include a device for fine adjustment of phase, which device is described below with reference to FIG. 5.

Figure 5:
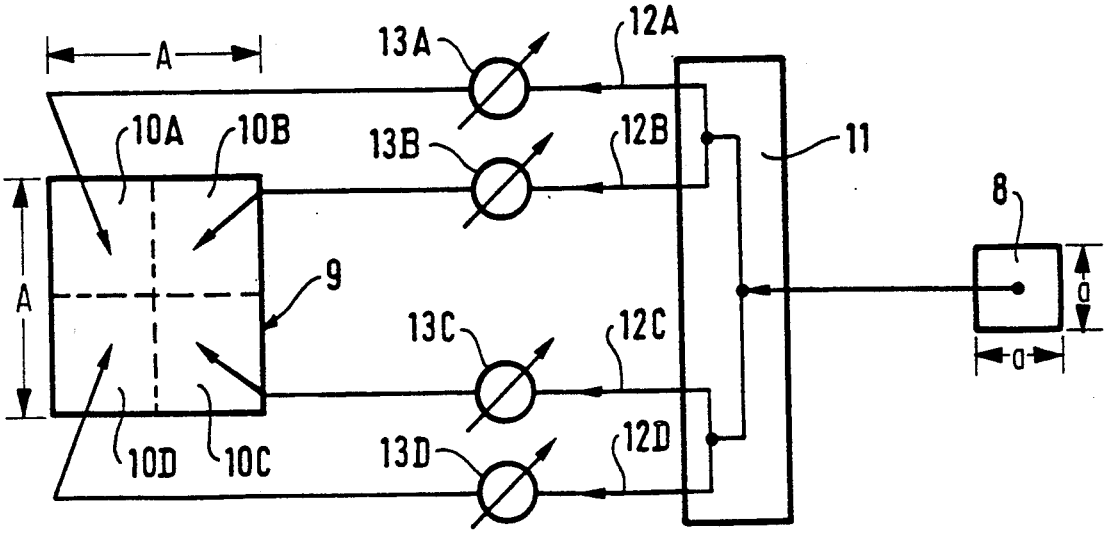
FIG. 5 is an electrical circuit diagram of one possible way of making connections with phase adjustment between a "small" source of the collector and the corresponding "big" source of the primary array.

In FIG. 5 the "big" unit source 9 is assumed to be made up of a mosaic of four horns 10A, 10B, 10C, and 10D. Naturally, this mosaic could comprise some other integer number p of horns; six, eight, or even more.

The receiver horn 8 is connected to a divide-by-p circuit (in this case a divide-by-4 circuit), referenced 11.

The p (in this case four) outlets 12A to 12D from said divider 11 are connected to the corresponding source area 10A to 10D via respective adjustable phase shifters 13A to 13D.

Fine adjustment is thus provided by means of these phase shifters 13A to 13D of the phase of the signal as re-emitted by the "big" unit source 9 towards the second reflector 4.

The primary array 7 is positioned, in this case, in the focal plane of the focus F' of the reflector 4, and the collector 6 is placed in the focal plane of the focus F of the reflector 3. Thus in the example shown, the collector 6 is relatively close to the primary array 7 and, to a first approximation, the two paraboloids 4 and 3 can be considered as being almost confocal.

One of the original features of the invention thus consists in using sources of different diameters for the collector 6 and for the primary array 7. The source-to-source connections between the collector and the primary array are such that, in fact, the sources of the primary array are excited with energy levels that are substantially equal to the levels received from the respective corresponding sources of the collector.

The illumination provided by the second reflector 4 is the image of the distribution picked up by the sources of the collector 6. The transformation between the distribution radiated by the primary array is a function of the characteristics of the collector sources 8 and of the primary array sources 9, naturally taking account of the fine phase adjustment provide by the various phase shifters 13A, 13B, 13C, . . .

It should be observed that the connections shown in FIG. 5 are made source-to-source, taking account of their respective positions in each of the arrays 6 and 7.

Figure 6:
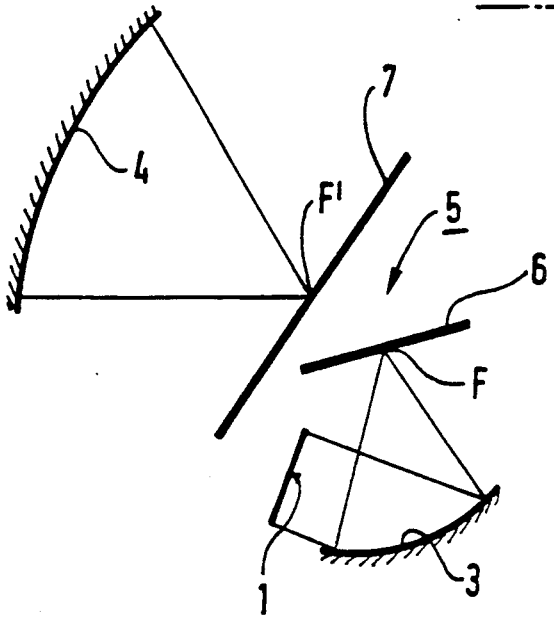
FIG. 6 is a view similar to FIGS. 1 and 2, showing a variant embodiment of an antenna of the invention.

FIG. 6 shows a variant of the above-described antenna. In this variant, the collector 6 and the primary array 7 are placed on surfaces that are no longer parallel as is the case for the antenna shown in FIG. 2. The lens 5 is thus no longer a lens having a parallel faces.

This configuration has the advantage of making it possible to dissociate radio wave constraints from those applying to the mechanical installation of the elements that form parts of the antenna.

Naturally, the invention is not limited to the above-described embodiments. Although the invention is primarily intended for application to an antenna on board a satellite, the field of the invention is not limited thereto, and the invention may be applied equally well to an antenna on the ground.

I claim:

1. A two-reflector offset type active antenna including a radio wave lens at a common focal point of first and second confocal reflectors, said lens having a collector with a collector first face that receives and picks up a concentrated and reflected beam derived from a beam emitted by an active source of the antenna towards said first reflector that encounters said beam, said collector being placed at the focus of the first reflector, and a primary array having an opposite face which re-emits, towards said second reflector, energy transmitted to a second face of said primary array from the collector first face by means of interconnections, said primary array being placed at the focus of said second reflector;

the primary array and the collector have plural sources, respectively, and the sources of the collector are respectively connected in a one-to-one geometrical configuration preserving relationship to respective ones of the sources of the primary array; and wherein the connection between each source of the collector and the corresponding source of the primary array includes a device providing fine phase adjustment.

2. An antenna according to claim 1, wherein a first face surface area of the sources of the collector are considerably smaller in size than a second face surface area of the sources of the primary array, and said collector is considerably smaller than said primary array.

3. An antenna according to claim 2, wherein dimensions of the surface area of the primary array sources are of the order of several times greater than dimensions of the surface area of the collector sources.

4. An antenna according to claim 1, wherein each source of the primary array is built up from an integer number of juxtaposed smaller sources each source of which is connected to a source in the collector having the geographical position that corresponds to the position of said source in the primary array by means of its own phase adjustment circuit.

5. An antenna according to claim 1, wherein the collector and the primary array are carried by surfaces that are not parallel.

* * * * *